United States Patent [19]

Blakney et al.

[11] Patent Number: 4,608,572

[45] Date of Patent: Aug. 26, 1986

[54] BROAD-BAND ANTENNA STRUCTURE HAVING FREQUENCY-INDEPENDENT, LOW-LOSS GROUND PLANE

[75] Inventors: Thomas L. Blakney, Bellevue; Douglas D. Connell, Seattle; Bernard J. Lamberty, Kent; James R. Lee, Seattle, all of Wash.

[73] Assignee: The Boeing Company, Seattle, Wash.

[21] Appl. No.: 448,511

[22] Filed: Dec. 10, 1982

[51] Int. Cl.[4] ..... H01Q 1/48; H01Q 1/36

[52] U.S. Cl. ..... 343/792.5; 343/846; 343/895

[58] Field of Search ..... 343/792.5, 846–849, 343/789, 790, 828, 834, 837, 895, 806, 807, 829, 791, 792, 773, 786

[56] References Cited

U.S. PATENT DOCUMENTS

| | | | |
|---|---|---|---|
| 2,112,287 | 3/1938 | Hansell et al. | 343/828 |
| 2,297,513 | 9/1942 | Von Baeyer | 343/791 |
| 2,368,663 | 2/1945 | Kandoian | 343/773 |
| 2,650,985 | 9/1953 | Rust et al. | 343/783 |
| 2,724,052 | 11/1955 | Boyer | 343/783 |
| 2,764,757 | 9/1956 | Rust et al. | 343/783 |
| 2,785,397 | 3/1957 | Rust et al. | 343/753 |
| 2,820,221 | 1/1958 | Broussaud | 343/753 |
| 3,131,394 | 4/1964 | Wheeler | 343/895 |

(List continued on next page.)

FOREIGN PATENT DOCUMENTS

| | | | |
|---|---|---|---|
| 496698 | 10/1953 | Canada | 343/775 |
| 926599 | 5/1963 | United Kingdom | 343/775 |
| 1502100 | 2/1978 | United Kingdom | 343/773 |

OTHER PUBLICATIONS

Grekou et al, "Plane Equiangular 4–Arm Spiral Antenna with Conical Reflector", *Electronics Letters,* 1–2–3–75, vol. 11, No. 2, pp. 38–40.

Grekou et al, "Plane Equiangular 4–Arm Spiral Antenna with Conical Reflector and Cavity, Fitted into a Structure", *Electronics Letters,* 1975

Atia, "Analysis of Multiple–Arm Conical Log–Spiral Antennas", IEEE Trans. on Antennas and Prop., May 1971, pp. 320–331.

*Primary Examiner*—Eli Lieberman
*Assistant Examiner*—Michael C. Wimer
*Attorney, Agent, or Firm*—Christensen, O'Connor, Johnson & Kindness

[57] ABSTRACT

To optimize antenna bandwidth and efficiency in broadband antenna elements of the planar, multiarm spiral and log periodic types, a conically shaped ground plane characterized by progressively sized circumferential chokes, is arranged on a common axis with the axial center of the spiral or log periodic elements so that the electrical spacing between the excited regions of the log periodic of spiral elements and the ground plane maintains a constant one-quarter wavelength relationship. The progressively sized circumferential chokes on the ground plane cut off the flow of excessive radial currents along the ground plane surface to achieve an improved mix of excitation and reexcitation modes. In one embodiment, the circumferential chokes on the conical ground plane are partially shunted by shunting strips that electrically or capacitively bridge the choke walls to reestablish limited radial currents along the ground plane for sustaining certain desirable antenna modes. In another disclosed embodiment, the equivalent one-quarter wavelength relationship between the driven spiral or log elements and the reflecting ground plane is maintained in an antenna structure in which the driven elements are disposed on the surface of a dielectrically shaped cone and the ground plane andprogressively sized circumferential chokes are arranged in a generally planar array. In still another disclosed embodiment, the circumferential, progressively sized chokes are disposed on the interior reflective surface of a center-fed antenna horn, wherein the array of chokes has the effect of broad-banding the otherwise inherently narrow band characteristics of the horn.

27 Claims, 15 Drawing Figures

U.S. PATENT DOCUMENTS

| | | | |
|---|---|---|---|
| 3,162,858 | 12/1964 | Cutler | 343/753 |
| 3,192,531 | 6/1965 | Cox et al. | 343/895 |
| 3,262,121 | 7/1966 | Holloway | 343/859 |
| 3,266,044 | 8/1966 | Bresler | 343/792.5 |
| 3,358,288 | 12/1967 | Dubost et al. | 343/789 |
| 3,434,146 | 3/1969 | Petrich | 343/772 |
| 3,555,554 | 3/1969 | Kuo | 343/895 |
| 3,588,903 | 6/1971 | Hampton | 343/873 |
| 3,618,107 | 11/1971 | Spanos | 343/773 |
| 3,641,578 | 2/1972 | Spanos et al. | 343/846 |
| 3,681,772 | 8/1972 | Ingerson | 343/895 |
| 3,686,674 | 8/1972 | Clasby et al. | 343/895 |
| 3,745,585 | 7/1973 | Barbano | 343/792.5 |
| 3,825,933 | 7/1974 | Debski et al. | 343/895 |
| 3,919,710 | 11/1975 | Fletcher et al. | 343/846 |
| 3,987,456 | 10/1976 | Gelin | 343/830 |
| 4,243,993 | 1/1981 | Lamberty et al. | 343/895 |

Fig. 1.
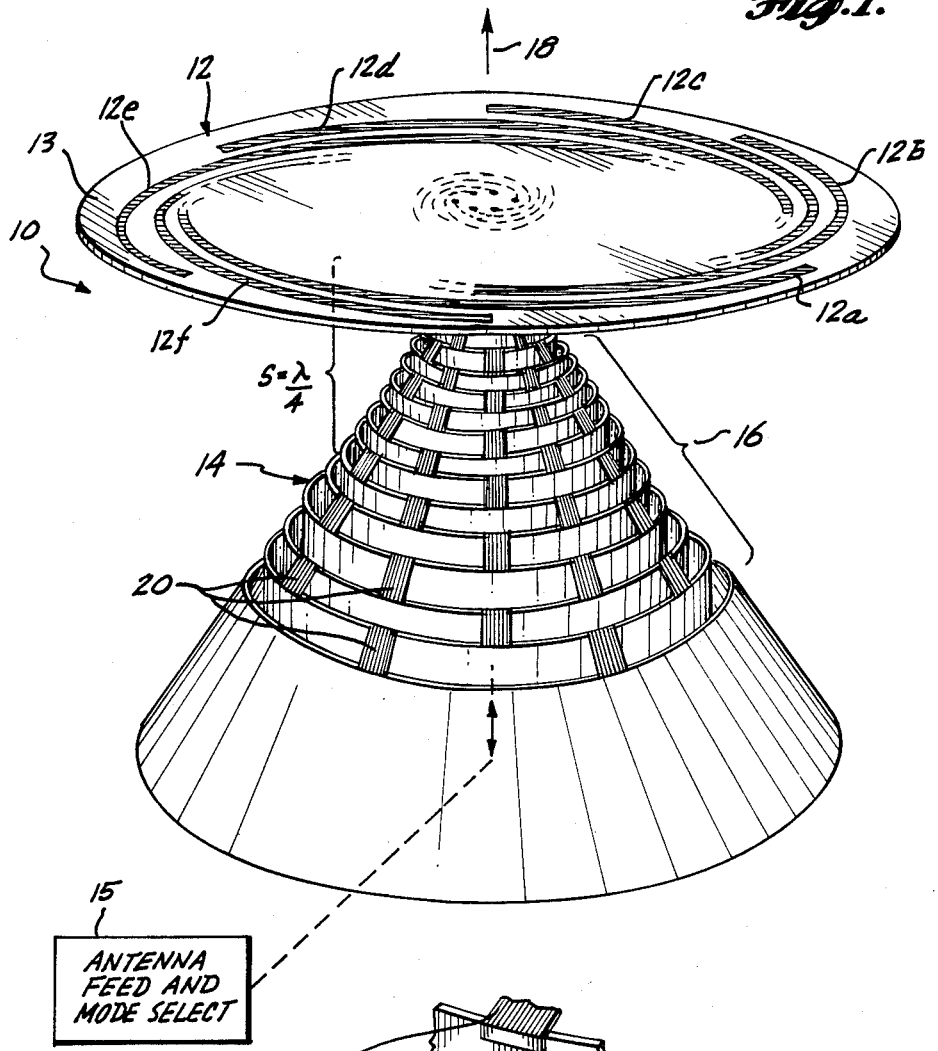
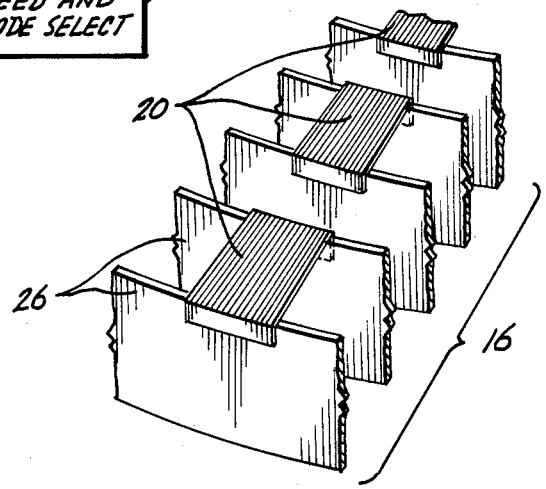
Fig. 4.

Fig. 5.
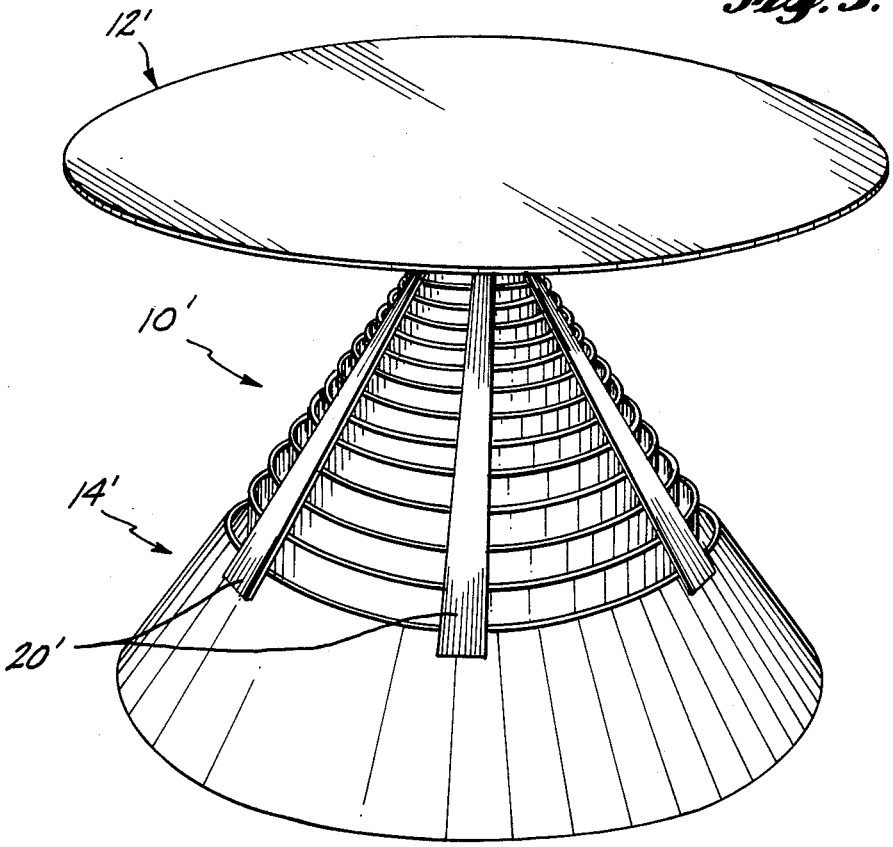
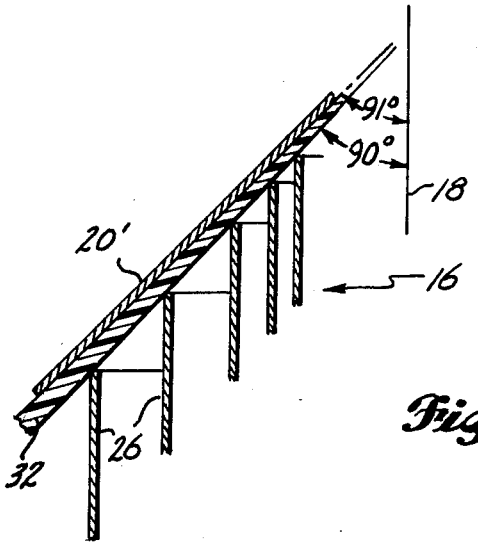
Fig. 5a.

Fig. 10.
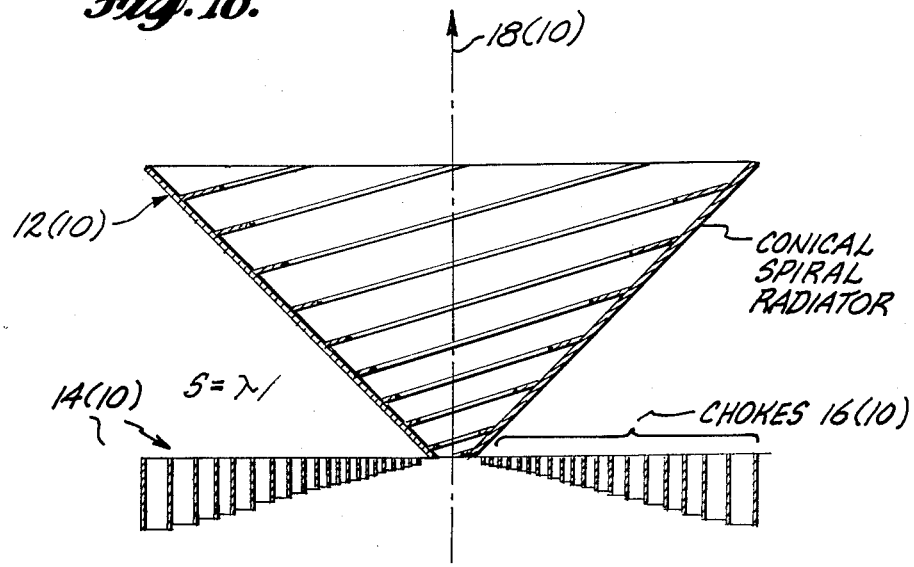
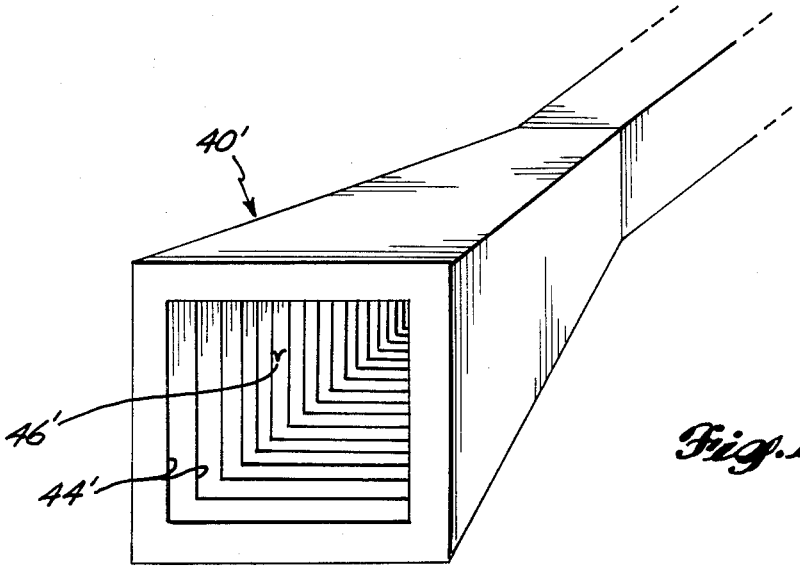
Fig. 12.

BROAD-BAND ANTENNA STRUCTURE HAVING FREQUENCY-INDEPENDENT, LOW-LOSS GROUND PLANE

BACKGROUND OF THE INVENTION

The invention relates to broad-band antennas and ground planes therefor.

In designing broad-band antennas, such as used for communication purposes, radar surveillance, and in general in any application where there is a need to receive signals over a bandwidth of an octave or more, there is a limited number of basic antenna configurations that are suitable. The most notable are: (1) log periodic, and (2) spiral types. These antenna configurations are multimode and may achieve a bandwidth ratio of 100:1. Both types (log periodic and spiral) may have been used in combination with various ground plane shapes and designs; however, the inventors herein have found that existing ground plane configurations unduly limit the performance that is theoretically predicted for log periodic and spiral antennas.

In general, the purpose of the ground plane is to efficiently redirect one axis of radiation from the log periodic or spiral antenna elements. When these antenna structures are excited, without the provision of a ground plane, the energy is radiated bidirectionally along the axis of the antenna away from its center; however, the radiation pattern in most applications is useful in one direction only and the radiation in the undesired direction must be either absorbed, thereby reducing efficiency, or reflected in the desired direction. The ground plane serves the latter purpose by first blocking off the radiation in the unwanted direction and, furthermore, causes that energy to be reflected back through the excited or driven antenna element and outwardly along the desired axis of radiation, reinforcing the energy that propagates directly (without reflection) from the excited antenna element. However, commonly used ground plane configurations and fabricating materials are believed to either restrict the otherwise theoretically attainable bandwidth, or to develop such large resistive losses that the overall antenna efficiency is drastically reduced.

To understand the limitations of existing antenna configurations, it is helpful to list some important characteristics of spiral and log periodic antennas. In such antenna configurations, the radially innermost area of the antenna is active at the higher frequencies of the antenna bandwidth and the active region of the antenna progressively advances outwardly and radially as the frequency decreases and the wavelength increases, to the outermost perimeter of the antenna, at which the antenna is active at the lowermost frequencies of the antenna bandwidth. In this sense, the spiral and log periodic antennas are frequency-independent, or as is sometimes said, frequency-repeating in that the electrical properties of the antenna repeat at radially increasing circles as the frequency decreases, each frequency level exciting a different annular region of the antenna.

One prior art ground plane configuration is a flat conductive metal plate arranged in combination with a flat planar, spiral radiating antenna element situated approximately one-quarter of a wavelength above the flat ground plate. The shortcoming of a flat ground plate in combination with a planar spiral radiating element is that the electrical spacing between the spiral and the ground plate varies with frequency but the physical spacing stays constant, thereby placing a constraint on the bandwidth of the device, typically limiting the bandwidth to about a 3:1 frequency ratio.

A number of configurations have been proposed to remove this particular bandwidth constraint. One effort to broad-band the ground plane is to form it in the shape of a cone in which the physical spacing, between the planar spiral element and the ground cone surface of which the radiation is reflected, increases in the radially outward direction so that the electrical spacing, which also increases radially outward from the center of the spiral, maintains an approximately constant one-quarter of the wavelength relationship at all radial locations.

However, this conical "ground plane," when configured with a regular, smooth conical surface, has been found by the inventors herein to generate or sustain undesirable modes of excitation which either diminish or destroy certain other and desired antenna modes that are associated with optimum radiation patterns. In particular, it is believed that such undesirable excitation modes result from rearward radiation from the driven antenna element being reflected at abnormal or unpredictable angles from the cone surface which reexcite different regions of the antenna in a nonconstructive manner. Although these destructive reflections are not fully understood, it is believed that they are due, in part, to excessive radial currents that are not present in a flat ground plane, which suppresses such radial currents because of the close and parallel spacing between the flat ground plane surface and the flat plane of the driven elements. In the conical ground plane, due to the increasingly greater physical spacing between the cone surface and the planar radiating elements, it is thought that the radial currents are not sufficiently suppressed and become excessive. The undesired reexcitation modes are normally at higher orders than those modes that produce the initial or primary radiation. Previous attempts to solve these excessive radial currents, such as by use of resistive radial fins on the cone structure and/or embedding a spiral antenna in a spiral cavity, have not met with success, either because of loss of efficiency or practical limitations due to the proposed antenna geometries.

In regard to the above discussion of "ground planes," it is noted that the term "plane" is a misnomer when used to refer to conical and other nonplanar ground or reflector configurations; however, the term "ground plane" is accepted as a term of art meaning an antenna structure or component that electrically serves to reflect wave energy in a way analogous to a conventional, flat ground plane, and is used herein to convey this broader functional meaning.

Not all prior art attempts to broad-band the directional antennas of the above type have involved the use of reflective ground planes. In one proposed configuration, the radiating spiral or multiarm spiral is shaped itself in a conical configuration. For acceptable unidirectionality of the radiating pattern, the spiral antenna cone must have an overall length of a wavelength or more, and hence the shape of the resulting structure does not lend itself to flush mounting applications. In this regard, it is frequently desirable in using these broad-band multiarm log periodic and spiral antennas, to mount the plane of such antennas flush with the surface of an aircraft and hence, when the antenna shape is reconfigured for its electrical properties, the resulting geometry is not always optimum for flush mounting.

Another disadvantage of the conical spiral is that the electrical phase center moves axially along the cone, causing severe defocusing that reduces the antenna gain when used to feed a parabolic reflector. Furthermore, when the conical spiral is excited in multiple modes, the phase center for each mode has a different axial position which again creates defocusing losses different for each mode.

SUMMARY OF THE INVENTION

Based, in part, on our discovery of the presence of excessive radial currents on the surface of a conical ground plane in an antenna structure formed by a planar spiral and ground cone, and our theory that such excessive radial currents contribute to unwanted excitation modes when the antenna structure is excited, a novel antenna structure has been devised in which a reflective ground plane surface thereof, such as the surface of a conical ground plane, is formed with a plurality of circumferential chokes arranged coaxially with the driven elements of the antenna and progressively sized from the smallest, associated with the highest frequencies of the broad-band antenna, to the largest, associated with the lowest antenna frequencies.

Thus, in a preferred embodiment of the novel antenna structure, the progressively sized chokes are disposed as an array of coaxial, circumferential slots opening into the surface of a conical shaped ground plane, and increasing in size from the smallest chokes adjacent the apex of the cone to the largest chokes adjacent the base of the cone. At the cone apex, the smaller radial and depth dimensions of the chokes are effective to choke off radial ground plane currents associated with the highest frequency excitation modes of the antenna that lie adjacent the center of spiral or log periodic planar elements. The relatively larger chokes at the radially outermost, and hence lowermost, portions of the ground plane are associated with the antenna elements driven at the lowest frequencies. The progressively sized chokes are disposed on the sloping cone surface so that each choke section generally underlies (in an imaginary cylinder coaxial with the antenna axis) the active region of the spiral or log periodic antenna at the frequencies to which the choke is matched.

In the above-summarized, preferred embodiment, the spacing along the axis of the antenna structure between the spiral or log periodic antenna and the circumferential choke structures that generally form the conical surface of the ground plane maintains a one-quarter wavelength relationship with the frequencies of concern at any given radius. Furthermore, in the case of the preferred antenna structure, it is desired to operate the antenna alternately or simultaneously in first and second modes. For such an embodiment, the circumferential chokes are dimensioned and located on the conical ground plane surface so that the chokes are matched to a frequency that is associated with a radius of the driven antenna elements lying approximately half-way between their characteristic first and second excitation modes, as disclosed more fully herein.

Still another aspect of the above-summarized, preferred embodiment, is the addition of conductive shunts disposed on the conical ground plane to bridge, at circumferentially distributed locations, the openings of the circumferential choke slots. These conductive shunts, which preferably are disposed in a circumferentially staggered pattern, in which the shunts on adjacent chokes are circumferentially offset, have been found to further optimize the radiation pattern produced by the antenna structure. As described more fully herein, it is believed that these conductive shunts provide an improved balance between radial and circumferential currents on the ground plane by reestablishing some radial current flow that is otherwise substantially cut off by the unshunted chokes in a combination of the choked conical ground plane and circularly polarized spiral antenna elements. A related, alternative preferred embodiment of the shunted chokes is disclosed in which conductive metallic strips are arranged at circumferentially spaced locations, each strip being continuous along the slant of the cone but with a capacitively coupled dielectric spacing between the strip and walls of the choke structures.

As mentioned above, in the particular and preferred form of the conical ground plane structure having the progressively sized circumferential chokes, the electrical spacing between the planar active elements of the antenna and the conical ground plane is maintained constant at one-quarter of a wavelength. A broader aspect of the invention is thus the provision of a combination driven antenna element and ground plane of the spiral and log periodic type in which the spacing between the ground plane and driven elements is maintained at this constant one-quarter wavelength even though the shapes of the driven elements and the ground plane vary from planar to conical. In this respect, an alternative embodiment takes the form of a flat ground plane incorporating the progressively sized circumferential chokes arranged coaxially with a conical shaped spiral or conical shaped log periodic driven element. The one-quarter wavelength electrical spacing is maintained as a function of the frequency-dependent radial dimension, as the antenna frequencies vary from the highest (radially innermost antenna regions) to the lowest (peripheral antenna regions). Similarly, a hybrid antenna structure is contemplated in which both the driven element and ground plane are of a conical shape, while maintaining the constant one-quarter wavelength spacing is contemplated.

Still another aspect of the invention is the arrangement of progressively sized, circumferential chokes on the inside surface of a broad-band horn antenna, coaxial with the horn opening. In this embodiment, the higher frequency chokes with their smaller dimensions are located adjacent the innermost and hence smallest cross section of the horn and the chokes progressively increase in size (axial spacing and radial depth) along the sloping inside walls of the horn to the largest dimension chokes arranged at the horn mouth. The result is a broad-band horn in which the higher frequencies are released from the horn structure before reaching the mouth by virtue of the intervening, progressively sized chokes along the horn interior wall. Progressively decreasing frequencies are hence radiated from the horn structure at locations along its axis, starting at the small end and moving toward the horn mouth. A broad-band operation is thereby established in which the band frequencies are not constrained to a particular, narrow frequency band dictated by the overall dimensions of the horn. This broad-band horn configuration is to be contrasted with horn antennas having corrugated structures along the inside horn wall which have been previously employed to suppress undesired radiation modes in a narrow-band radiator. In such case, the choke-forming corrugations are of uniform dimension, tuned to the narrow band of the horn antenna.

While certain preferred embodiments are disclosed herein in the form of circular driven elements and circular section ground planes, the invention is not restricted to such circular configurations. The principles of the invention embodied in the driven elements, ground planes and horns, referred to above and disclosed in greater detail herein, can be incorporated in non-circular antenna configurations including multisided pyramids, polygons and elliptical conics. For example, common antenna art sometimes calls for multiarm spirals in which the progression from the center follows straight lines along a square configuration rather than circular. In such cases, the preferred ground plane may be a pyramid having a rectangular horizontal section, with chokes in straight lines along the sidewalls of the pyramid. Similarly, six- or eight-element log periodic antennas may be best combined with six- or eight-sided pyramids as the corresponding choke-imbedded ground planes rather than circular, conical ground planes. The above-described embodiment of the horn having chokes in the interior walls includes horns of various cross sections, including circular, rectangular, polygonal or elliptical.

To provide a complete disclosure of the invention, reference is made to the appended drawings and following description of one particular and preferred embodiment.

BRIEF DESCRIPTION OF THE DRAWINGS

FIG. 1 is an isometric view of a preferred embodiment of the antenna structure in accordance with the invention wherein a broad-band, multiarm spiral planar antenna element is combined with a reflecting, conical ground plane formed with progressively sized circumferential chokes and distributed choke shunts;

FIG. 4 is a detail view of the distributed shunts bridging the circumferential chokes of the antenna structure of FIG. 1.

FIG. 5 is an isometric view of an alternative embodiment in which the shunting of the progressively sized, circumferential chokes is by capacitively coupled, conductive strips disposed along the slant of the conical ground plane;

FIG. 5*a* is a detail view of a fragment of the embodiment shown in FIG. 5;

FIG. 10 is an axial sectional view of still a further alternative embodiment of the antenna structure in which the ground plane and progressively sized chokes are configured in a generally flat, planar structure and cooperate with a spiral, driven antenna element arranged in the shape of a cone;

FIG. 12 is an isometric view of an alternative horn embodiment related to the embodiment of FIGS. 11*a* and 11*b* but having a square rather than circular axial cross section.

DETAILED DESCRIPTION OF PREFERRED EMBODIMENTS

Figure 2:
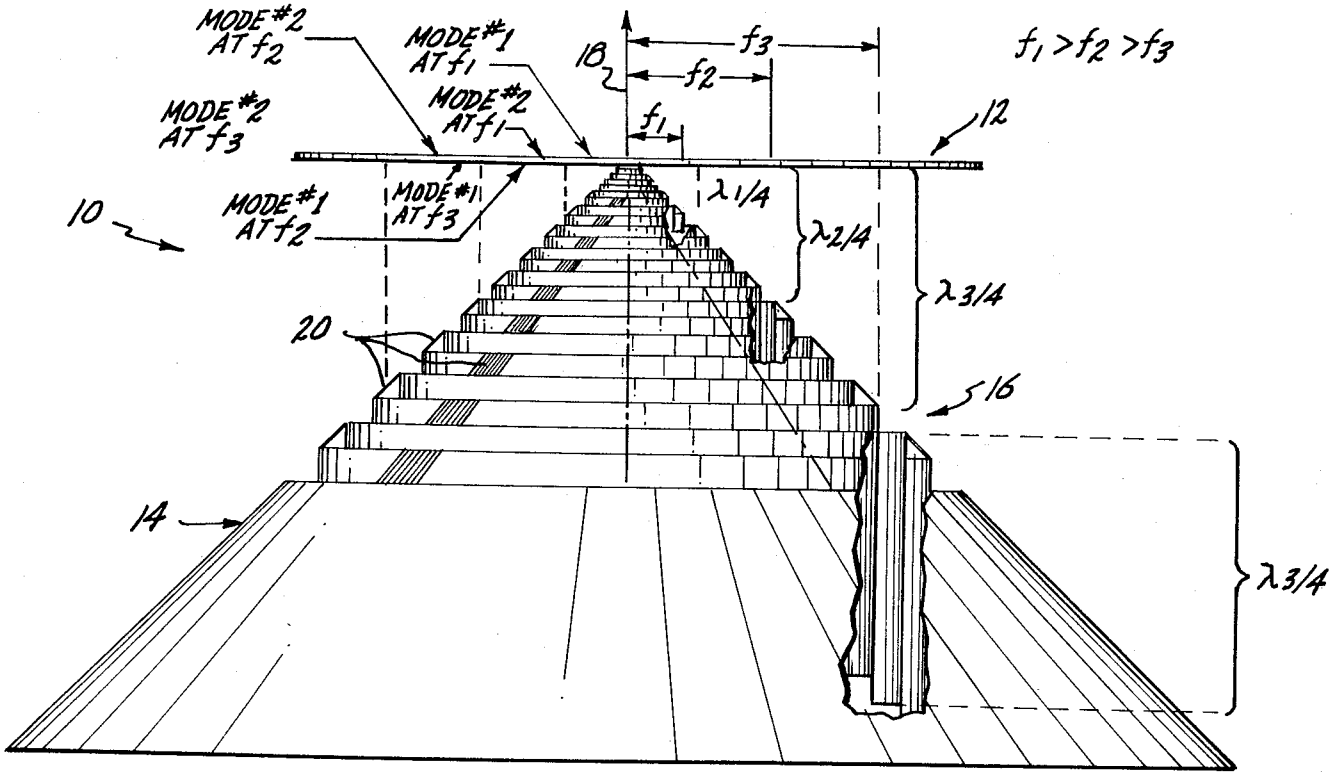
FIG. 2 is an elevational view (partly broken away for clarity) of the antenna structure of FIG. 1.

FIG. 1 shows an antenna structure 10 embodying the principles of the invention by combining a broad-band, spiral-type, multiarm driven antenna element 12 with a generally conical ground plane 14 constructed with a plurality of progressively sized, circumferential chokes 16 all arranged in a coaxial assembly about antenna axis 18. The conductive, spiral arms 12*a*–12*f* are mounted on a dielectric substrate 13 such that when the radiator arms are excited, and assuming the absence of conical ground plane 14, maximum antenna gain (i.e., radiation and reception) occurs bidirectionally generally along antenna axis 18, both upwardly and downwardly as viewed in FIG. 1. The placement of ground plane 14 beneath element 12 serves to reflect the initial downward radiation from element 12 back up through arms 12*a*–12*f* and dielectric 13 in the direction of the desired propagation upwardly about axis 18 as viewed in FIG. 1. Arms 12*a*–12*f* of antenna element 12 are fed at the center of the spiral array by an antenna feed and mode select subsystem 15 that is coupled to the individual arms 12*a*–12*f* in a manner known per se for both exciting these elements in one or more desired modes of operation during transmission and reception. While element 12 (and corresponding elements in other embodiments) is sometimes referred to herein as a driven element to indicate that it is the primary excitation component of the antenna structure, it will be appreciated that this term does not limit the antenna operation to transmission and includes reception operation as well.

The wall of ground plane 14 extends circumferentially around antenna axis 18 and diverges in the direction away from element 12 so as to create a spacing S between the ground plane surface and element 12 which increases as a function of increasing radius; however, the effective electrical separation corresponding to spacing S maintains a constant one-quarter wavelength electrical separation $\lambda/4$ because of the properties of element 12, which, as described above, cause different annular regions of element 12 to be excited at different frequencies. More specifically, as described below, the highest frequencies of the broad-band antenna excite annular regions of element 12 closest to the center of the structure and hence at the smallest radius, and lower frequencies within the antenna bandwidth excite annular regions of element 12 at progressively larger radial locations. The lowest antenna frequencies excite element 12 at the radially outermost annular regions of arms 12*a*–12*f*. The higher frequencies and hence the smaller wavelengths $\lambda$, lie adjacent axis 18 where the physical spacing S to the ground plane 14 is smallest, and the lower frequencies and hence larger wavelengths are associated with the greater physical spacing S between element 12 and ground plane 14 near the radially outermost portions of structure 10.

In accordance with the principles of the invention, progressively sized chokes 16 on the divergent wall surface of ground plane 14 that faces the underside of element 12 prevent excessive radial currents from developing, which currents are believed by us to interfere with optimum excitation and reexcitation (by reflections) of element 12. The provision of chokes 16 may also be thought of as a way of limiting these radial currents to a level that exists in a flat ground plane arranged parallel to the planar configuration of element 12 and still retain the advantages of the constant quarter wavelength $S=\lambda/4$ relationship afforded by the diverging wall ground plane such as provided here by the conical shape.

When circumferential chokes 16 are properly dimensioned and located as described more fully hereinafter, the otherwise occurring radial current components can be abruptly cut off. Our investigations have also determined that such a complete or abrupt cut-off of all radial current modes, can be counterproductive by allowing certain undesired excitation modes; however, such modes can be suppressed by creating a small, controlled amount of radial ground plane current that is balanced with the magnitude of circumferential currents. Thus, as shown in the preferred form of antenna structure 10 of FIG. 1, and as depicted in greater detail in FIG. 4, mode-suppressing shunts 20 are arranged to bridge the boundary walls of chokes 16 at circumferentially and radially distributed locations on ground plane 14. As described in greater detail below, shunts 20 are of conductive material and can be electrically bonded or capacitively coupled to the boundary walls of chokes 16 at their openings.

To best understand the construction and operation of the antenna structure having the array of chokes in ground plane 14, a discussion of the properties, known per se, of multiarm spiral antennas is helpful. One principle of a multiarm spiral configuration as shown by element 12 in FIG. 1 is that it is excitable in a plurality of different modes, the number of which is related to the number of arms by the relationship: number of modes=number of arms−1. Thus, the six-arm spiral of radiator 12 has five excitation modes. In the particular embodiment of FIG. 1, we are interested in two operating modes of the antenna, which shall be called mode 1 and mode 2. As is known per se, these two modes in the six-arm spiral element 12 can be used for ascertaining the angular direction of a distant emitter.

The first operating mode has a radiation distribution pattern characterized by a single, generally circular lobe (when viewed in axial cross section) symmetrical about axis 18. The second mode has two lobes when viewed in axial cross section (it is actually a single lobe of generally annular configuration symmetrical about axis 18 and encircling the center lobe formed by the first excitation mode). The first (mode 1) and the second (mode 2) of antenna structure can be selected alternately as a way of finding the angle of arrival of a signal from a distant emitter. The amplitude and phase relationship of the received signal, when the antenna is excited in mode 1, versus the amplitude and phase of the received signal when in mode 2, has a predictable relationship to the angle of arrival of the signal, and this relationship can be used as a measure of the angular direction.

With reference to FIG. 2, antenna structure 10, having the array of progressively sized chokes 16 in conical ground plane 14 is shown together with legends indicating that this particular antenna structure is designed to operate over a bandwidth including frequencies f1, f2, and f3, where the increasingly greater annular regions of radiator 12 indicated on the right-hand side of FIG. 2 are associated with these three particular operating frequencies. The quarter wavelength relationship for the associated wavelengths $\lambda 1$, $\lambda 2$, and $\lambda 3$ is indicated in the spacing S between radiator 12 and the conical profile of ground plane 14. On the left-hand side of the axis 18 of antenna structure 10, the active annular regions of radiator 12 for modes 1 and 2 for each of the three examples frequencies, f1, f2, and f3, are shown by arrow pointers. Thus, mode 1 at f1 occurs at a radial region of radiator 12 just slightly inside of the radial position beneath which the $\lambda\frac{1}{4}$ choke with its quarter wavelength spacing for frequency f1 is positioned. Mode 2 for frequency f1 is located at a radial region somewhat greater than the radial position of the $\lambda\frac{1}{4}$ quarter wavelength choke. Similarly, modes 1 and 2 for frequency f2 and modes 1 and 2 for frequency f3 are indicated and the radial positions of the associated chokes at $\lambda 2/4$ and $\lambda\frac{3}{4}$ are shown to be approximately midway between the radial regions of the operating modes 1 and 2 at the associated frequencies f2 and f3.

Figure 3:
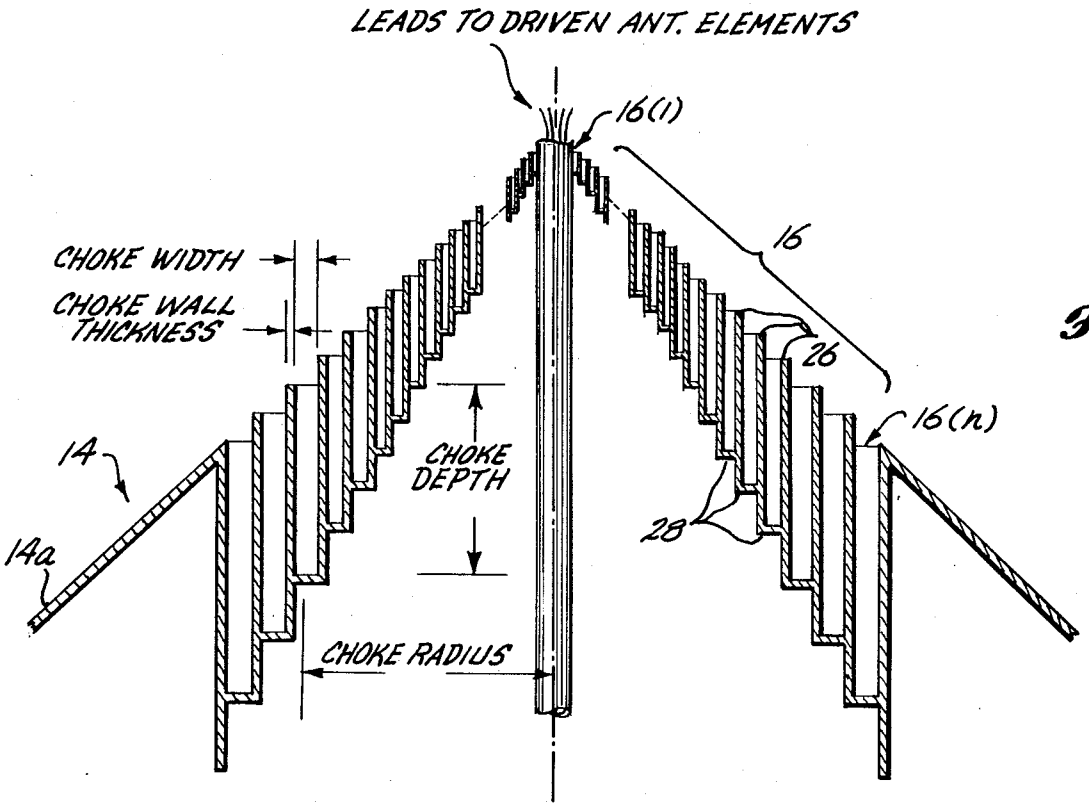
FIG. 3 is a vertical sectional view of the ground plane and progressively sized circumferential chokes of the antenna structure of FIG. 1.

With reference to FIG. 3, chokes 16 are shown in greater detail to comprise a plurality of n progressively sized circumferential and coaxial slots in the surface of a conductive, conical wall 14*a* and opening toward element 12. The size of the slot-shaped chokes 16 varies from the smallest choke 16 (1) adjacent the apex of the conical ground plane to the largest slot-shaped choke 16 (*n*) adjacent the base of the conical ground plane 14. The boundary between adjacent chokes 16 is defined by a cylindrical wall 26 coaxial with axis 18 terminating at the opening to the inwardly adjacent choke and extending downwardly to the bottom wall 28 of the outwardly adjacent choke. Thus, in effect, ground plane 14 may be thought of as a cone of revolution formed by the downwardly and outwardly stepwise array of chokes 16 as shown in FIG. 3. The depth of each choke is selected to be one-quarter of the wavelength of the excitation energy existent at the particular radial position of each choke. Thus, with reference to FIG. 2, the choke 16 at a spacing S of $\lambda\frac{3}{4}$ will correspondingly have a quarter wavelength depth of $\lambda\frac{3}{4}$ as indicated.

The radial separation of walls 26 (choke width) and the thickness of walls 26 can be varied for empirically optimizing the antenna performance but are not believed to be critical to antenna operability. The width is generally a small fraction of the quarter wavelength depth and by way of example, a choke width of approximately one-eighth of the quarter wavelength depth has been found satisfactory. The thickness of walls 26 may vary depending upon the position within the array of chokes 16, using a thinner choke wall 26 for the smaller sized chokes and a thicker wall 26 for the largest of the chokes.

The smallest choke 16 (1) as shown in FIG. 3, is preferably at a quarter wavelength at a frequency that is above the highest operating frequency of the antenna; similarly, the largest choke 16 (*n*) is at a quarter wavelength at a frequency below the lowest frequency of the antenna bandwidth. By providing chokes that transcend the highest and lowest operating frequencies, uniform performance of the antenna even at the edges of its bandwidth, is assured. The radial distance in wavelengths from the antenna axis 18 to each quarter wavelength choke 16 is a selectable parameter and depends on the excitation modes of the antenna. As mentioned above in connection with FIG. 2, for this particular multiarm spiral radiator 12, the individual chokes are located at a radial position that lies midway between first and second excitation modes. Tested embodiments have shown that the optimum location of the chokes in this case is about one-quarter wavelength in radius from axis 18, which corresponds to the above-mentioned positioning midway between the active annular regions of the first and second modes.

Shunts 20 are provided to reestablish limited, controlled radial current along the choked conical ground plane 14 in order to suppress certain undesired excitation modes that were found to occur in some applications using chokes 16 without shunting. More specifically, the absence of shunts on chokes 16 when in combination with a circularly polarized antenna such as spiral element 12 caused degradation of the axial ratio. It is believed that the reason for such degradation is that the chokes 16 transport radially polarized fields but because of the abrupt cut-off of radial current components, the unshunted chokes do not support circumferentially polarized fields radiating from spiral radiator 12. This, in turn, is believed to result in the reflection of different types of fields from different surfaces of the ground plane. Also, by comparison with the flat ground plane reflector referred to above in the background section, radial currents in the prior art flat ground plate configuration are known to attenuate gradually at radially increasing regions of the ground plane diminishing to minimal levels adjacent the perimeter. In contrast, radial currents are substantially eliminated by the array of chokes 16 in our antenna structure 10. Thus, to reestablish some limited and radially diminishing current flow in ground plane 14, shunts 20 as shown in FIGS. 1, 2, and 4 are provided. In this embodiment, shunts 20, as viewed in FIG. 4, are strips of a highly conductive metal such as copper bridging adjacent pairs of choke walls 26 and bonded to the bridged walls by suitable means such as soldering or use of an electrically conductive adhesive. To limit such reestablished radial current flow, conductive shunts 20 are circumferentially staggered on adjacent chokes 16 so that sets of radially interrupted shunts 20 are positioned in radial alignment on every other choke 16 and with each set circumferentially offset from the others. The amount of current flow is dependent on the number of such sets of shunts 20, the widths of the individual shunt strips, and their conductivity. By empirical trial and error, the number and distribution of the shunts 20 is increased from none while testing the antenna performance until a desired, optimum operation is reached and exceeded, with the excess of shunts then being removed to optimize the design.

In the embodiment shown in FIGS. 1 through 4, and by way of example, a broad-band antenna has been constructed according to the following specifications:

Bandwidth: 1000 mHz to 4000 mHz;

Ground plane 14: −90° cone having 26 circumferential chokes;

Smallest choke 16 (1) having a radius measured from axis 18 of 0.738 inches and a quarter wavelength depth of 0.738 inches;

The diameter of the largest choke 16 (*n*) is 12.6 inches or a radius from axis 18 of 6.3 inches and a choke depth of 6.3 inches; and Antenna element 12 is a six-arm spiral in which the maximum spiral diameter is approximately 12 inches.

An alternative embodiment incorporating the shunting of the ground plane chokes is shown in FIGS. 5 and 5*a* in which the conductively bridging strip shunts 20 of the above embodiment are replaced by a series of circumferentially spaced, capacitively coupled strip shunts 20′ on conical ground plane 14′. With reference to FIG. 5*a*, conductive strip shunts 20′ are arranged radially along the downwardly and outwardly sloping profile of the diverging cone wall portions and are separated from the conductive edges of choke walls 26 by a dielectric spacer 32. Thus, conductive shunts 20′ are capacitively coupled to the conductive walls of chokes 16 at the openings thereof. In this instance, a set of six conductive shunts 20′ are arranged at equal circumferential increments around conical ground plane 14′. The width of strip shunts 20′, capacitive coupling as determined by the thickness of dielectric spacer 32 and the actual number of conductive shunts 20′ can be varied and optimized by the above-noted empirical approach.

In this particular example, the capacitive coupling of conductive strips 20′ is gradually decreased with increasing radius of ground plane 14′ by a dielectric spacer 32 that has increasing thickness in accordance with the ratio of a 90° cone formed by the upper extent of walls 26 of chokes 16 and a 91° cone at the interface between dielectric spacer 32 and conductive shunt 20′ as shown in FIG. 5*a*. By way of example, a suitable capacitive gap provided by dielectric spacer 32 is such as to form a gap of approximately 1/100th of a wavelength at the operating frequency of the particular choke element.

Figure 6A:
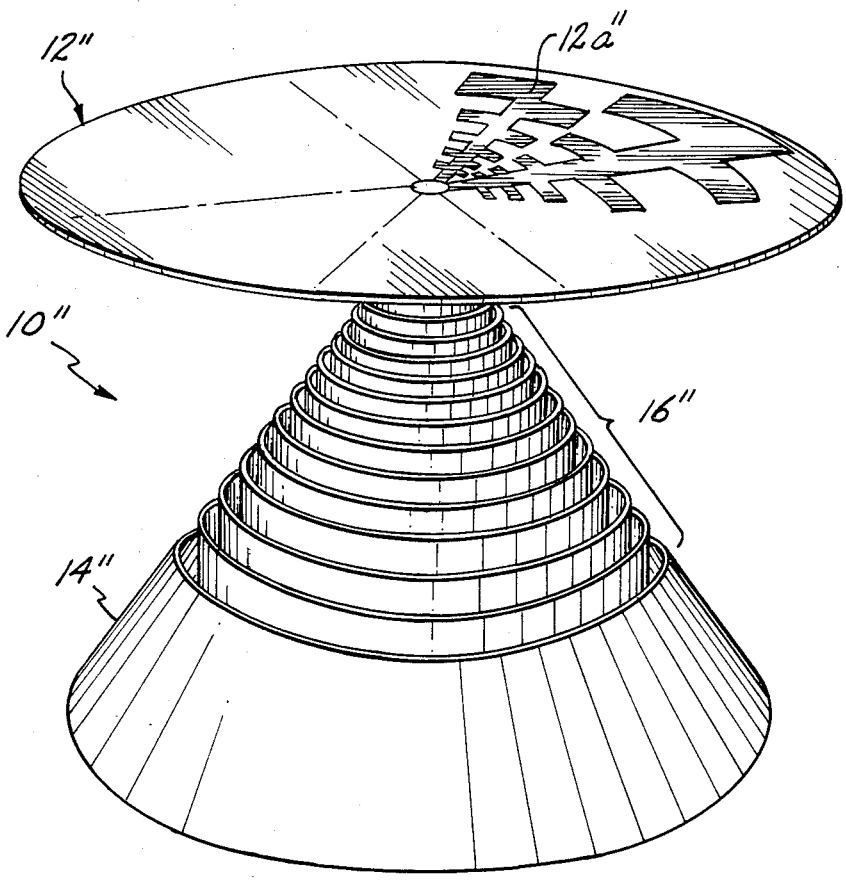
FIG. 6*a* is another alternative embodiment of the antenna structure in which the progressively sized, circumferential chokes of the ground plane are unshunted and the ground plane is combined with a broad-band driven element of the planar log periodic type.
Figure 6B:
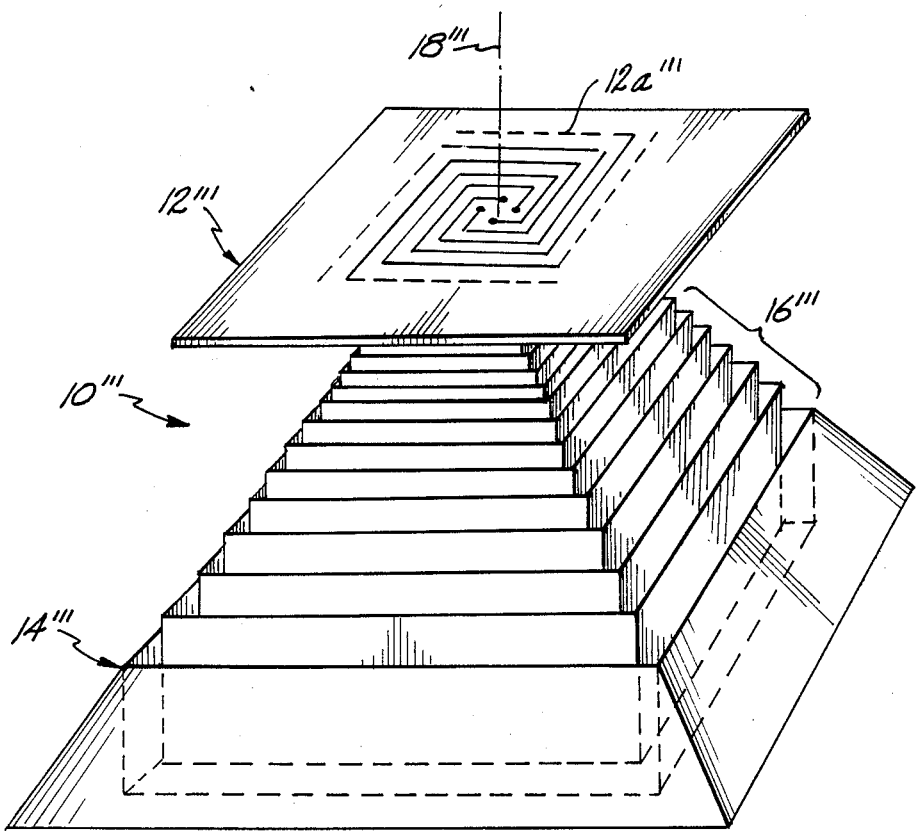
FIG. 6*b* is a further alternative embodiment of the antenna structure in which the driven elements form a square planar spiral and the choked ground plane is in the shape of a pyramid.

Other alternative embodiments are shown in FIGS. 6*a* and 6*b*. Antenna structure 10″ in FIG. 6*a* has a planar, multiarm log periodic element 12″ as the driven element in lieu of a spiral element. As is known per se, log periodic antennas may comprise a plurality of identical log periodic radiating arms 12*a″*.

Because of the somewhat different modes of excitation of the planar log periodic element 12″ in the embodiment of FIG. 6*a*, the associated conical ground plane 14″ omits the above-described shunts across the openings of circumferential chokes 16″. The abrupt cut-off of radial currents is not believed to be as harmful to the operating modes of the log periodic element 12″ and hence the choke shunts may be omitted in some applications of this configuration. Otherwise, the construction and operation of antenna structure 10″ is similar to the embodiment of FIGS. 1 through 4.

Antenna structure 10‴ in FIG. 6*b* incorporates the above-described principles in a configuration of planar spiral driven element 12‴ in which each of the multiple conductive spiral arms 12*a‴* are formed by an array of straight segments of progressively increasing lengths and joined end-to-end at right angles to assume a generally square-shaped spiral arm. A pyramid-shaped ground plane 14‴ is geometrically and electrically matched to the square spiral element 12‴, in which plane 14‴ is roughly conical but with a square base and flat sidewalls that converge from the base toward the apex of plane 14‴ where element 12‴ is arranged perpendicular to the antenna axis 18‴. Chokes 16‴ are sized and located in a progression corresponding to the above-described embodiments, but here the choke-forming slots extend in straight lines along the flat sidewalls of ground plane 14''' and intersect at right angles at the sidewall corners.

Figure 7:
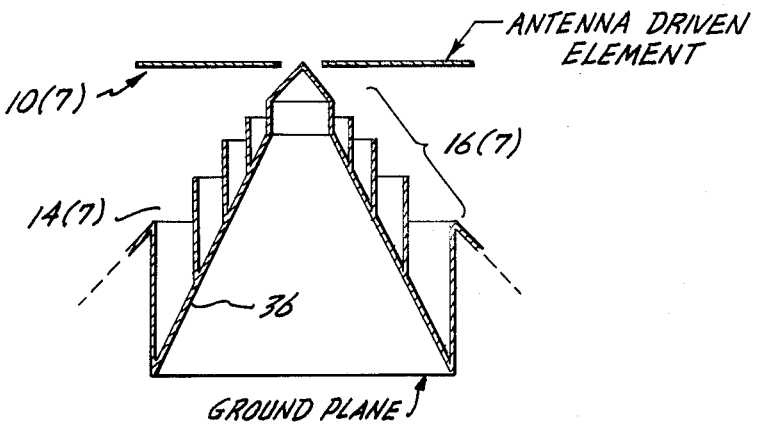
FIGS. 7, 8, and 9 are axial sectional views of alternative configurations of the progressively sized ground plane chokes shown in combination with the planar driven antenna elements.
Figure 8:
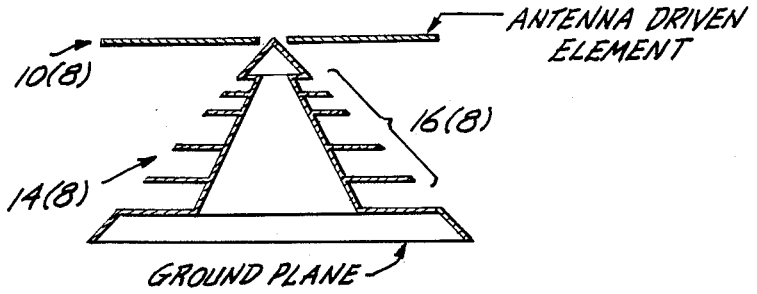
Figure 9:
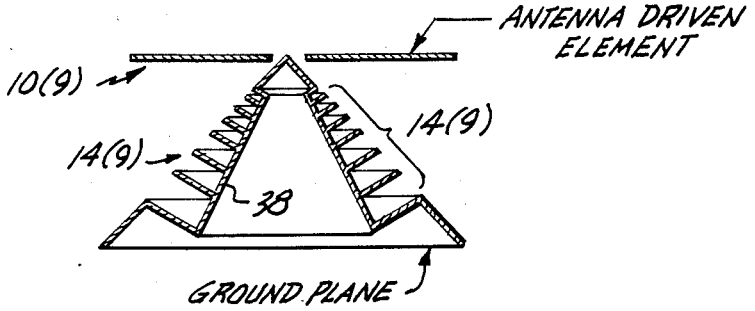

FIGS. 7, 8, and 9 show various configurations of the circumferentially disposed ground plane chokes in antenna structures 10 (7), 10 (8), and 10 (9). Each of these antenna structures has a driven element of the planar broad-band type such as the multiarm spiral type of element 12 shown in the embodiment of FIG. 1. The conical ground plane is, however, modified in each case. In FIG. 7, antenna structure 10 (7) has a conical ground plane 14 (7) in which the circumferential, progressively sized chokes 16 (7) have a bottom defined by the wall of another cone 36 having a more severe pitch than the profile of the cone defined by chokes 16 (7). Compared to the chokes of antenna structure 10 in FIG. 1, chokes 16 (7) do not have a flat, regular bottom, but, rather, are formed by a sloping circumferential segment of cone 36. While the electrical properties of such an irregular choke shape are not rigorously defined, practical experience established that such chokes will be substantially as effective as chokes 16 of FIGS. 1 through 4. Similarly, antenna structure 10 (8) of FIG. 8 has a modified conical ground plane 14 (8) in which the chokes 16 (8) are formed by flat, horizontally parallel and axially spaced annular sections, the perimeters of which define the conical profile of the ground plane while the choke openings extend radially inwardly rather than parallel to the axis of the antenna structure. In FIG. 9, ground plane 14 (9) is shown to be a hybrid of the FIGS. 7 and 8 embodiments and chokes 14 (9) are formed by annular walls that project outwardly and upwardly from a foundation cone 38 that, in addition to supporting the choke walls, defines the bottoms of the chokes.

In FIG. 10, still a further alternative embodiment of the antenna structure is shown in which a multiarm, spiral-type of antenna element 12 (10) assumes a conical shape, while the array of circumferential chokes 16 (10) are arrayed to define at the openings of the chokes, a flat or planar surface. Thus, the geometrical relationship of the flat spiral arms and the conical ground plane of the previous embodiments has been reversed in the antenna structure 12 (10) while maintaining the same constant quarter-wavelength spacing between the driven antenna elements and the chokes 16 (10). In operation, the spiral arms of element 12 (10) are center-fed as in the case of the embodiment shown in FIG. 1, and the radiating patterns are symmetrical to the antenna axis 18 (10). Ground plane 14 (10) including the array of chokes 16 (10) reflect the energy back through the conical spiral element. It is observed that the embodiment shown in FIG. 10 is the extreme example of altering the configuration of the antenna structure 10 of FIG. 1 so as to decrease the pitch of conical ground plane 14 (gradually flatten it out) and correlatively evolve the flat planar element 12 into an upwardly biased cone shape, while maintaining the same $S=\lambda/4$ relationship described in connection with FIG. 1.

Figure 11A:
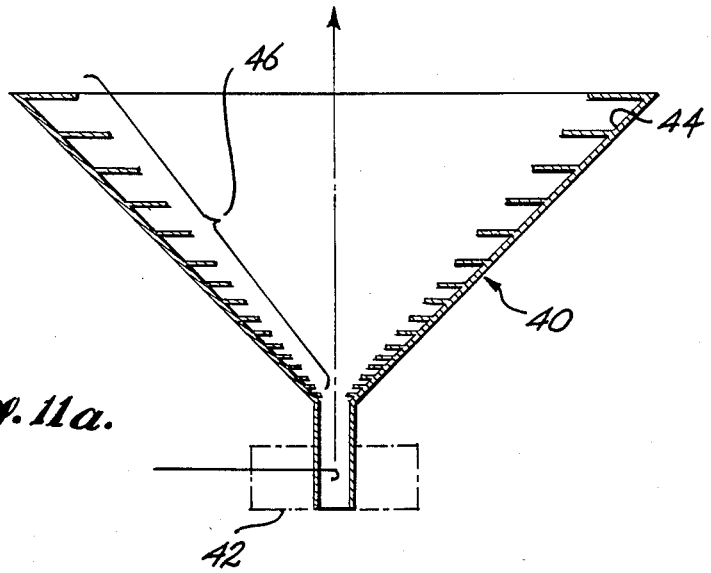
FIGS. 11*a* and 11*b* are axial sectional and isometric views of another alternative embodiment of the antenna structure in which the progressively sized chokes are arranged along the interior reflective wall surface of an antenna horn.
Figure 11B:
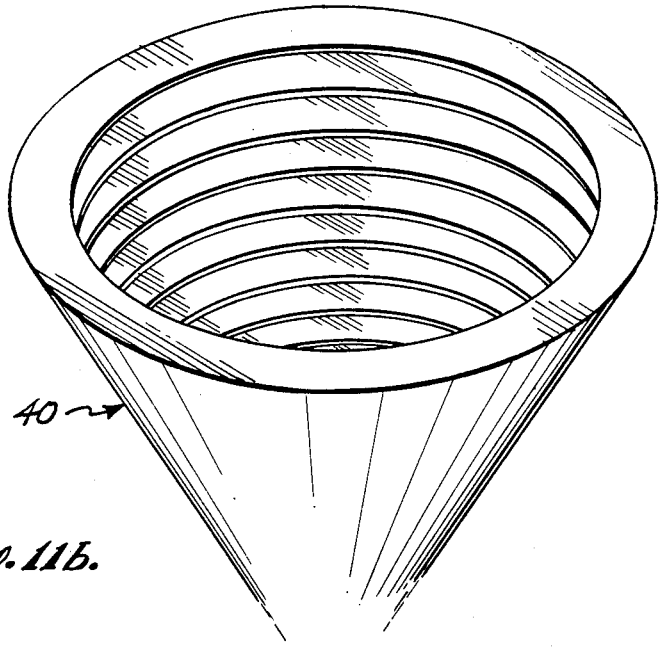

FIGS. 11*a* and 11*b* show a different embodiment of the principles of the invention in which the progressively sized and circumferentially arranged chokes are arranged on the inside reflective surface of a broad-band, conical horn 40 fed at the apex of horn 40 by feed assembly 42. The progressively increasing sized, circumferentially disposed chokes 46 are arranged in accordance with the principles and theories discussed above, such that the smaller choke sizes are located adjacent the horn center so as to sustain antenna excitation at the highest frequencies of the antenna and the progressively increasing choke size with horn radius sustains only progressively lower frequency components. Hence, starting at the smallest radius of the horn center, as entering broad-band excitation frequencies encounter chokes 46, the higher frequencies are progressively cut off by the increasing size of chokes 46 and are released by the horn wall surface 44. The intermediate frequency components are in turn cut off by the larger chokes 46 and are released midhorn, and the lowest frequencies are the last to be cut off and released by the largest chokes near the horn's mouth. Thus, the horn 40 equipped with progressively sized chokes 46 causes a broad-banding of the antenna horn not otherwise exhibited by such antennas. The receiving characteristics of horn 40 is by the reciprocity of antenna structures, also broad-band.

FIG. 12 depicts an antenna horn 40' similar to horn 40 of FIGS. 11*a* and 11B, but differing therefrom in that horn 40' is of non-circular cross section and, more particularly, has a rectangular section which in this embodiment is a square. The chokes 46' are conformingly shaped relative to the interior walls of horn 40' and the operation of the horn is as described above in connection with FIGS. 11*a* and 11*b*.

While only particular embodiments have been disclosed herein, it will be readily apparent to persons skilled in the art that numerous changes and modifications can be made thereto, including the use of equivalent means, devices, and method steps without departing from the spirit of the invention.

The embodiments of the invention in which an exclusive property or privilege is claimed are defined as follows:

1. An antenna structure comprising:

a directional, frequency-repeating, broad-band driven element arranged around an axis of antenna directivity and having excitation characteristics that vary with the radius from said axis, said excitation characteristics concentrating relatively higher signal frequencies in regions of said element proximate said axis, and concentrating progressively lower signal frequencies in regions of increasing radius from said axis out to a perimeter of said element;

a matching broad-band reflective ground plane formed around said axis and so arranged with said element that signal energy is reflected by said ground plane back toward said element generally along said axis, said ground plane having an array of circumferential chokes proximate said axis and matching the relatively higher signal frequencies of excitation on said element in said regions thereof proximate said axis, and said chokes on said ground plane progressively increasing in size with increasing radius so as to match the progressively lower frequencies of excitation at regions of said element of corresponding radius out to said perimeter of said element, said circumferential chokes limiting the inducement of radial currents on said ground plane; and shunt means associated with said chokes for controlled shunting of radial currents on said ground plane.

2. The antenna structure of claim 1 wherein said shunt means comprise:

a plurality of strips of conductive material arranged on said ground plane in conductively bridging relationship across the chokes.

3. The antenna structure of claim 1 wherein said shunt means comprise strips of electrically conductive material arranged at circumferentially staggered locations on said chokes on said ground plane in conductively bridging relationship across said chokes.

4. The antenna structure of claim 1 wherein said shunt means comprises strips of conductive material arranged radially and at circumferentially spaced locations overlying said chokes, and gap-forming means for mounting said strips so as to proximate, but electrically gapped from said chokes for capacitive coupling of said strips to said chokes.

5. The antenna structure of claim 1 wherein said regions on said driven element are physically spaced from regions on said ground plane of corresponding radius from said axis by a spacing that increases with increasing radius, and increasing spacing having a constant electrical separation related to the changing wavelength of the signal frequencies of excitation in regions of said element at increasing radius.

6. The antenna structure of claim 5 wherein said electrical separation is one-quarter of a wavelength of the excitation frequencies associated with a given radius.

7. The antenna structure of claim 1 wherein said driven element is of a spiral planar shape defining a center through which said axis passes, and said ground plane has a conical shape in which the apex of the conical shaped ground plane is positioned proximate the center of said element.

8. The antenna structure of claim 7 wherein said element is of generally circular, spiral shape and said conical shaped ground plane is of circular, conical shape.

9. The antenna structure of claim 1 wherein said element is in the shape of a spiral formed by a plurality of end-to-end connected straight segments.

10. The antenna structure of claim 9 wherein said ground plane has the shape of a multisided pyramid, the apex of which is located proximate a center of the spiral shaped element.

11. The antenna structure of claim 1 wherein said driven element is of a circular, conical shape and said ground plane is of a circular, substantially flat shape.

12. The antenna structure of claim 1 wherein said driven element is in the shape of a spiral.

13. The antenna structure of claim 1 wherein said driven element is a multiarm spiral.

14. The antenna structure of claim 1 wherein said driven element is of a multiarm, log periodic type.

15. An antenna structure comprising:

a directional, frequency-repeating, broad-band driven element arranged around an axis of antenna directivity and having excitation characteristics that vary with the radius from said axis, said excitation characteristics concentrating relatively higher signal frequencies in regions of said element proximate said axis, and concentrating progressively lower signal frequencies in regions of increasing radius from said axis out to a perimeter of said element; and a matching broad-band reflective ground plane formed around said axis and so arranged with said element that signal energy is reflected by said ground plane back toward said element generally along said axis, said ground plane having an array of circumferential chokes proximate said axis and matching the relatively higher signal frequencies of excitation on said element in said regions thereof proximate said axis, said chokes on said ground plane progressively increasing in size with increasing radius so as to match the progressively lower frequencies of excitation at regions on said element of corresponding radius out to said perimeter of said element, the terminal portions of said circumferential chokes that are positioned nearest to said driven element collectively defining the effective surface of said reflective ground plane, said circumferential chokes limiting the inducement of radial currents on said ground plane.

16. The antenna structure of claim 15, further comprising shunt means associated with said chokes for controlled shunting of radial currents on said ground plane.

17. The antenna structure of claim 16 wherein said shunt means comprise:

a plurality of strips of conductive material arranged on said ground plane in conductively bridging relationship across the chokes.

18. The antenna structure of claim 16 wherein said shunt means comprise strips of electrically conductive material arranged at circumferentially staggered locations on said chokes on said ground plane in conductively bridging relationship across said chokes.

19. The antenna structure of claim 16 wherein said shunt means comprises strips of conductive material arranged radially and at circumferentially spaced locations overlying said chokes, and gap-forming means for mounting said strips so as to proximate, but electrically gapped from said chokes for capacitive coupling of said strips to said chokes.

20. The antenna structure of claim 15 wherein said driven element is of a spiral planar shape defining a center through which said axis passes, and said ground plane has a conical shape in which the apex of the conical shaped ground plane is positioned proximate the center of said element.

21. The antenna structure of claim 20 wherein said element is of generally circular, spiral shape and said conical shaped ground plane is of circular, conical shape.

22. The antenna structure of claim 15 wherein said element is in the shape of a spiral formed by a plurality of end-to-end connected straight segments.

23. The antenna structure of claim 22 wherein said ground plane has the shape of a multisided pyramid, the apex of which is located proximate a center of the spiral shaped element.

24. The antenna structure of claim 15 wherein said driven element is of a circular, conical shape and said ground plane is of a circular, substantially flat shape.

25. The antenna structure of claim 15 wherein said driven element is in the shape of a spiral.

26. The antenna structure of claim 15 wherein said driven element is a multiarm spiral.

27. The antenna structure of claim 15 wherein said driven element is of a multiarm, log periodic type.

* * * * *